US005226706A

United States Patent [19]

Tuller

[11] Patent Number: 5,226,706

[45] Date of Patent: Jul. 13, 1993

[54] ADJUSTABLE DOOR BALANCING MECHANISM

[75] Inventor: Barry E. Tuller, Newton, Iowa

[73] Assignee: Maytag Corporation, Newton, Iowa

[21] Appl. No.: 804,775

[22] Filed: Dec. 9, 1991

[51] Int. Cl.[5] ..... A47B 77/00

[52] U.S. Cl. ..... 312/228; 312/229; 312/276; 312/319.4; 126/191

[58] Field of Search ..... 312/228, 229, 228.1, 312/311, 276, 319.4; 126/191, 194; 4/619

[56] References Cited

U.S. PATENT DOCUMENTS

| | | | |
|---|---|---|---|
| 1,963,388 | 6/1934 | Smith | 126/191 |
| 2,833,270 | 4/1952 | Brown | 126/191 |
| 3,055,724 | 9/1962 | Mazure | 312/319.4 |
| 3,058,737 | 7/1960 | Schibley | 267/1 |
| 3,183,550 | 10/1963 | Phelps | 16/190 |
| 3,250,267 | 5/1966 | Fry | 126/194 |
| 3,750,989 | 8/1973 | Bergeson | 248/23 |
| 3,820,866 | 6/1974 | Kaldenberg | 312/276 |
| 3,826,553 | 7/1974 | Cushing et al. | 312/229 |
| 4,021,968 | 5/1977 | Kendall | 49/386 |
| 4,194,452 | 3/1980 | Crowther et al. | 312/276 |
| 4,726,352 | 2/1988 | Radke | 126/191 |
| 4,951,693 | 8/1990 | Archambault | 312/276 |

FOREIGN PATENT DOCUMENTS

| | | | |
|---|---|---|---|
| 0100492 | 3/1937 | Australia | 126/194 |

*Primary Examiner*—Victor N. Sakran

*Attorney, Agent, or Firm*—Zarley, McKee, Thomte, Voorhees & Sease

[57] ABSTRACT

An adjustable counterbalance system is provided for an appliance cabinet having a door hinged to the cabinet for movement from a closed to an opened position. A counterbalance spring includes one end connected to the door and another end connected to a movable bracket which is mounted adjacent the lower edge of the cabinet wall. The bracket includes a lead screw which is positioned on the interior of the cabinet wall and which is accessible through an access opening in the front wall of the cabinet. Movement of the bracket toward and away from the door adjusts the tension in the spring.

20 Claims, 3 Drawing Sheets

ADJUSTABLE DOOR BALANCING MECHANISM

BACKGROUND OF THE INVENTION

This invention relates to an adjustable door balancing mechanism, and particularly to an adjustable door balancing mechanism for use in counterbalancing the door of a dishwashing machine.

Presently known dishwashing machines are adapted to be fitted under a kitchen counter with only the front wall of the dishwashing machine being exposed. The front wall includes a door which is hinged at the bottom and which folds outwardly to provide access to the interior of the dishwashing tub. Counterbalance springs have been provided for the door to prevent the door from falling in a free fall when it is opened about its horizontal axis at its lower edge.

During installation, and on occasion at later times, it is desirable to adjust the tension in the counterbalance spring which is attached to the door. However, with presently known devices, there is considerable difficulty in gaining access to the tension spring when the dishwashing machine is installed beneath a kitchen counter. On some dishwashing machines, access to the spring for changing spring tension can be gained through small openings in side supports. Generally, however, in order to adjust the tension in the spring, it is necessary to pull presently known dishwashing machines out from their installation beneath the kitchen counter so as to gain access to the spring and permit adjustment of the tension therein.

SUMMARY OF THE INVENTION

A primary object of the present invention is the provision of an improved adjustable door balancing mechanism.

A further object of the present invention is the provision of an improved door balancing mechanism for dishwashing machines, which can be adjusted without requiring the removal of the dishwashing machine from its installation beneath a kitchen counter.

A further object of the present invention is the provision of an adjustable door balancing mechanism for a dishwashing machine, which can be accessed from the front of the dishwashing machine while the machine is installed beneath the kitchen counter.

A further object of the present invention is the provision of an adjustable door balancing mechanism which provides adjustment in the tension in the counterbalance springs for the doors in infinitely small increments so as to permit precise adjustment of the tension.

A further object of the present invention is the provision of an adjustable door balancing mechanism which can be accessed by removal of an access panel at the front of the dishwasher so as to expose the adjustable door balancing mechanism within a compartment located at the bottom of the dishwashing machine behind the removable panel.

A further object of the present invention is the provision of an improved adjustable door balancing mechanism which is economical to manufacture, durable in use, and efficient in operation.

The present invention achieves these objects with an adjusting bracket which is slidably attached to the inwardly extending lower flange on the bottom of one of the side walls of the cabinet forming the dishwashing machine. The bracket includes an inner portion which is within a compartment formed between the two side walls of the tub support for the dishwashing machine. The bracket also includes an outer portion which is outside the tub support walls, and a middle portion which interconnects the inner and outer portions of the bracket. One end of the spring is connected to the outer portion of the bracket, and the other end of the spring is connected to the door for counter balancing the door.

A lead screw is rotatably mounted to two upstanding tabs on the inner portion of the bracket. The lead screw threadably extends through a tab which is folded inwardly from the tub support wall. Rotation of the lead screw causes longitudinal movement of the bracket along the lower edge of the tub support wall. Turning the lead screw will cause bracket movement which correspondingly increases or decreases tension in the door spring attached to the outer portion of the bracket.

The bracket is initially formed in a partially folded state, and is crimped around the horizontal inwardly extending lower flange at the lower edge of the tub support during manufacture of the dishwashing machine.

DESCRIPTION OF THE PREFERRED EMBODIMENT

Figure 1:
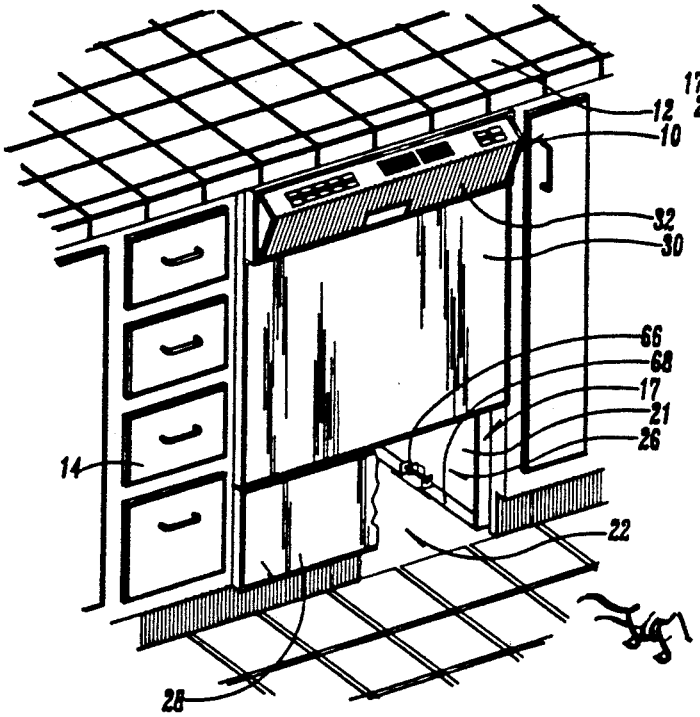
FIG. 1 is a perspective view of a dishwashing machine installed beneath a kitchen counter, and showing the lower access panel partially broken away so as to show the lower compartment of the dishwashing machine.

Referring to the drawings, the numeral 10 generally designates a dishwashing machine installed beneath a counter 12. Machine 10 is formed from a cabinet which is comprised of a tub 15 and a tub support 17. Tub 15 includes a top wall 16 and opposite side walls 18 which form a washing compartment 20 therein. Tub support 17 includes a pair of spaced apart tub support side walls 21 located beneath tub 15 and forming a lower compartment 22 therebetween.

Tub 15 includes a door opening 24 at the front thereof, and tub support 17 includes an access opening 26 which provides access to lower compartment 22. A removable access panel 28 covers the access opening normally, but can be removed for access to the interior of compartment 22.

Figure 2:
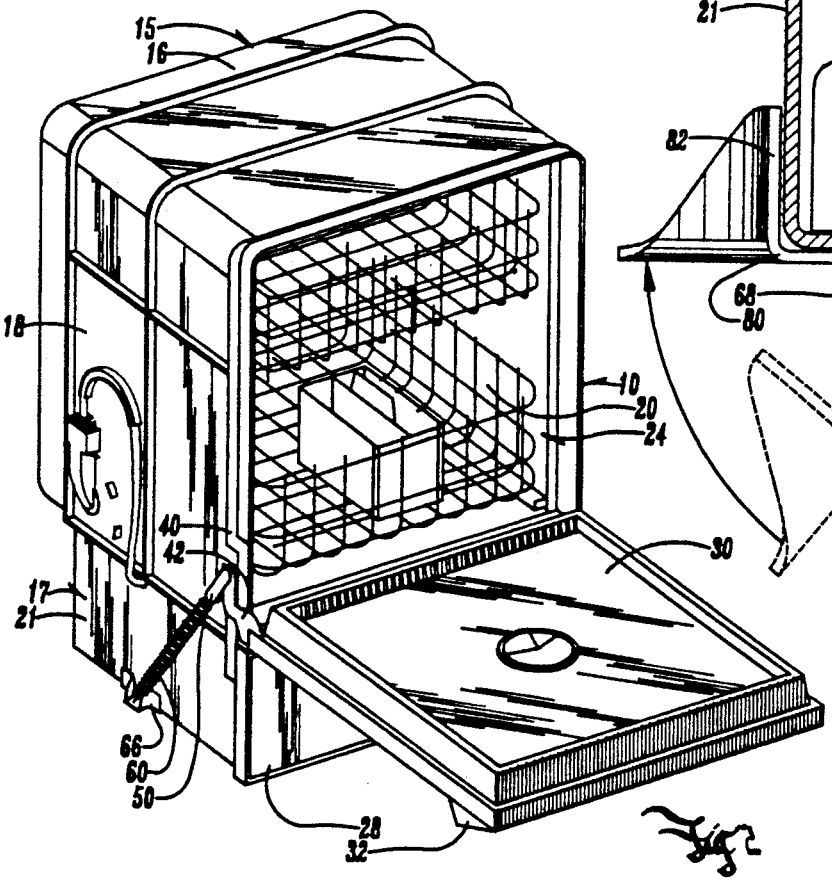
FIG. 2 is a perspective view of the dishwashing machine removed from beneath the kitchen counter.

A door 30 is hinged to the tub 15 for hinged movement from a closed position shown in FIG. 1 to an open position shown in FIG. 2. At the upper edge of door 30 is a control panel 32.

Figure 3:
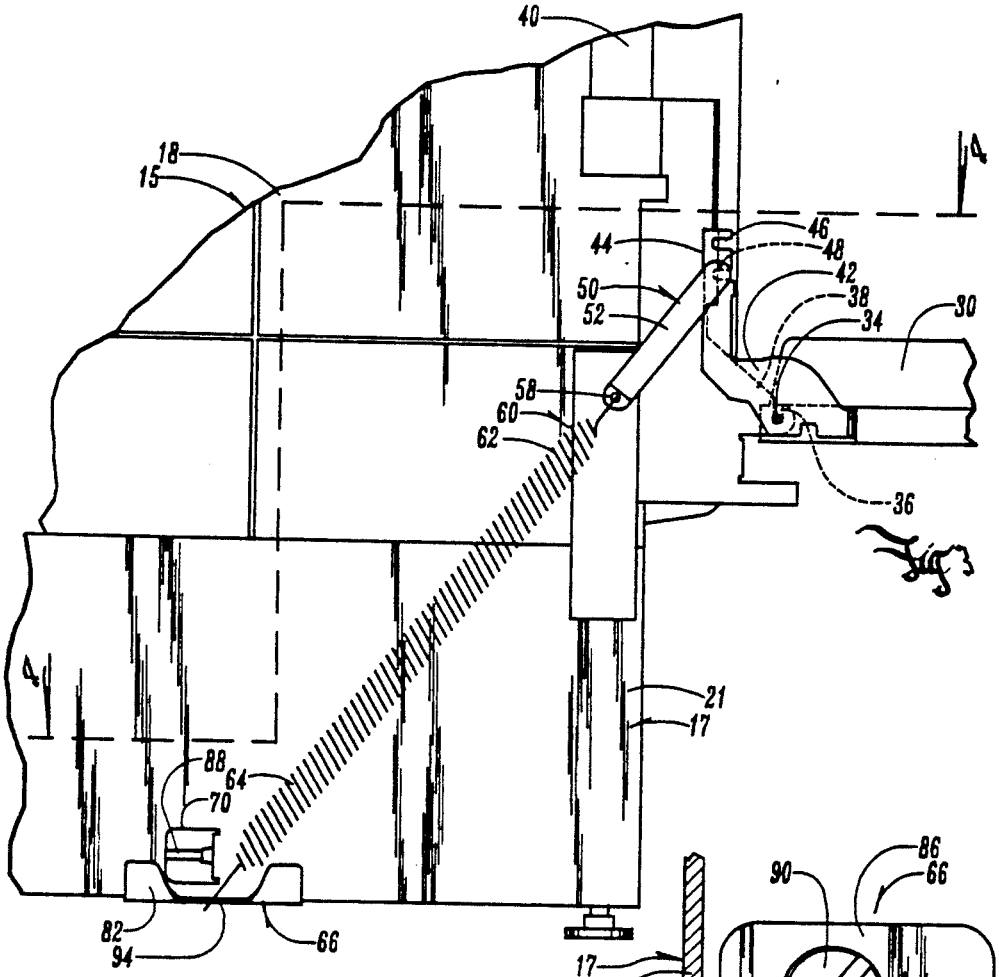
FIG. 3 is an enlarged side elevational view of the hinged connection of the door and the counterbalance spring for counter balancing the door.

Referring to FIG. 3, door 30 includes at its lower edge a hinge pin 34 which is rotatably received within an upwardly opening hinge notch 36 of a hinge support plate 38 which forms part of a collar assembly 40 surrounding tub 15. Hinge pin 34 extends through a hinge plate 42 which is attached to the door 30 and which includes an upstanding lever arm 44 having a pair of spaced apart spring notches 46, 48 therein.

A yoke 50 having a pair of spaced apart yoke arms 52, 54 (FIG. 4) includes a yoke pin 56 which is adapted to be fitted within either of the notches 46, 48. At the opposite end of yoke 50 from the yoke pin 56 is a spring receiving hole 58 which retentively receives the upper end 62 of a spring 60. Spring 60 includes a lower end 64 which is adapted to be attached to a spring adjustment bracket 66.

Figures 6, 7, 8:
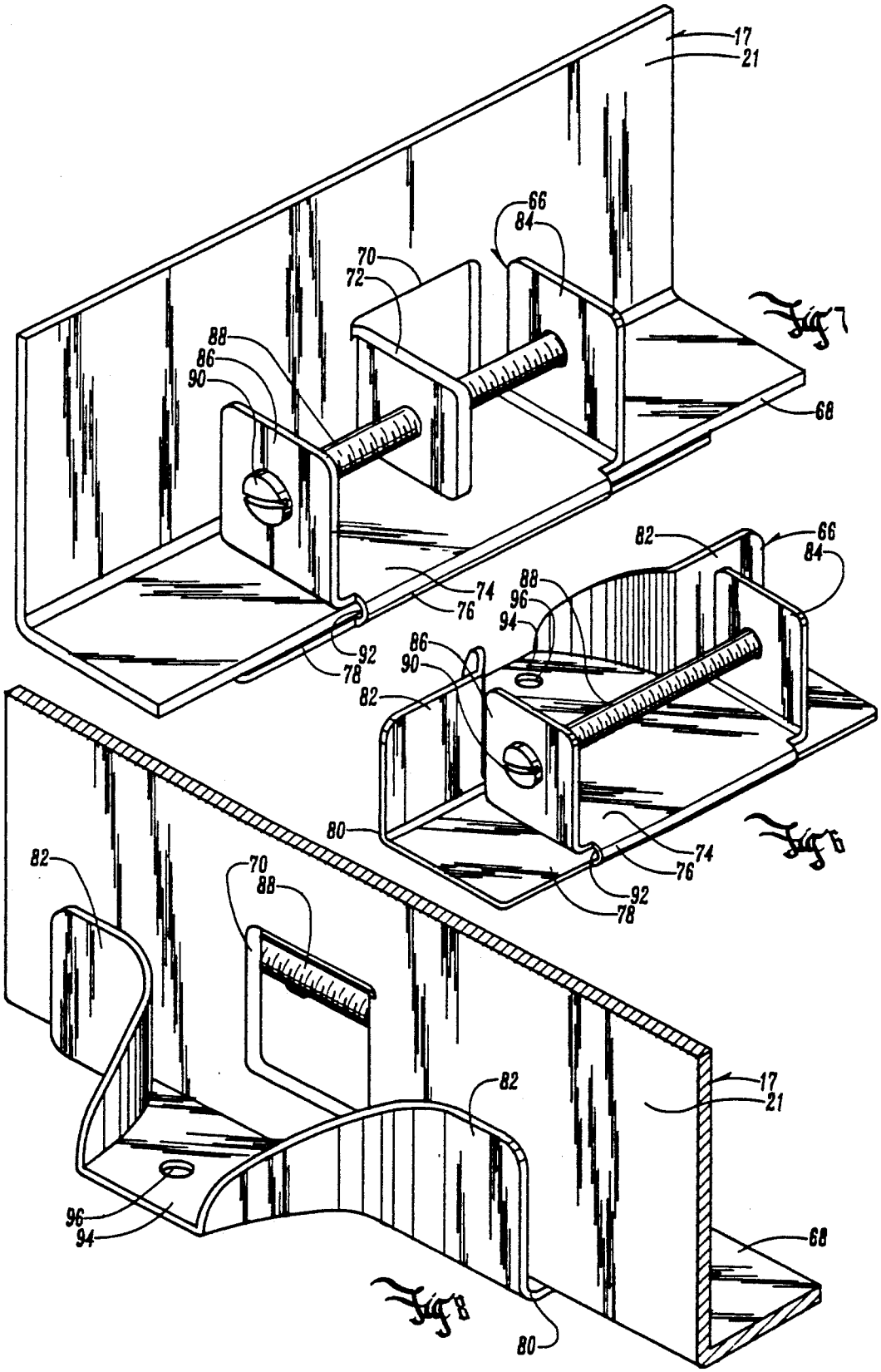
FIG. 6 is a perspective view of the adjustment bracket used in the present invention.
FIG. 7 is a perspective view showing the adjustment bracket on the lower flange of the tub support wall as viewed from the interior of the compartment between the tub support walls.
FIG. 8 is a perspective view of the bracket on the lower edge of the tub wall as viewed from the outside of the tub support wall.

Spring adjustment bracket 66 is slidably mounted on a horizontal flange 68 which is integrally formed at the lower edge each of the tub support side walls 21. A punched out hole 70 is also provided adjacent the lower edge of tub support side wall 21 and includes a folded in wall flap 72 (FIGS. 7 and 8).

Spring adjustment bracket 66 is formed from an inner plate 74 which is joined along a fold line 76 to a middle plate 78 which in turn is connected along a fold line 80 to an outer plate 82. Extending upwardly from inner plate 74 are a pair of spaced apart tabs 84, 86 which rotatably receive a lead screw 88 having a screw head 90 at one end thereof. Lead screw 88 threadably extends through a selfthreading opening in wall flap 72 so that rotation of the lead screw 88 causes the bracket to move longitudinally along the horizontal flange 68 at the lower end of tub support side wall 21.

Figure 9:
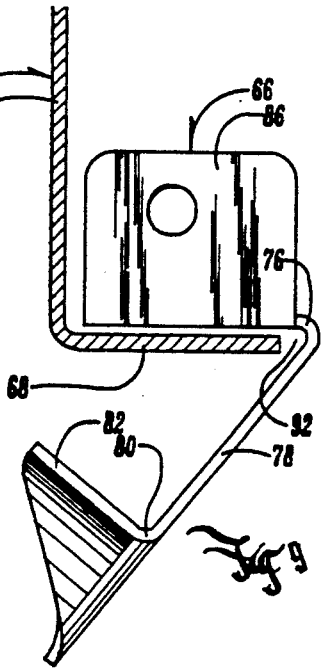
FIG. 9 is a sectional view similar to FIG. 5, but showing the bracket in its initial unfolded position.
Figure 10:
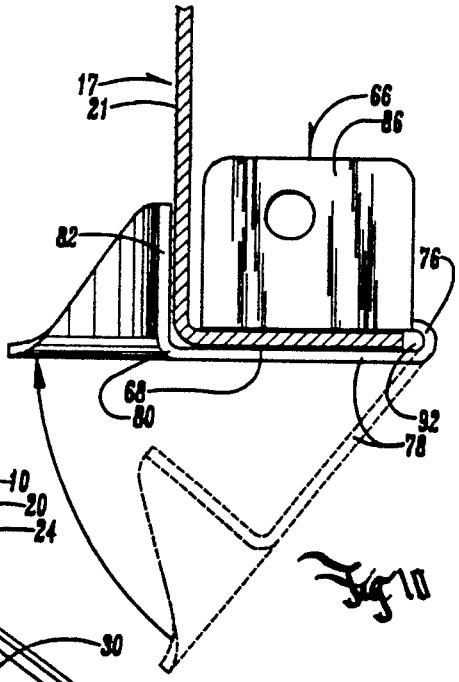
FIG. 10 is a sectional view similar to FIG. 9, but showing the bracket in its folded position.
Figure 5:
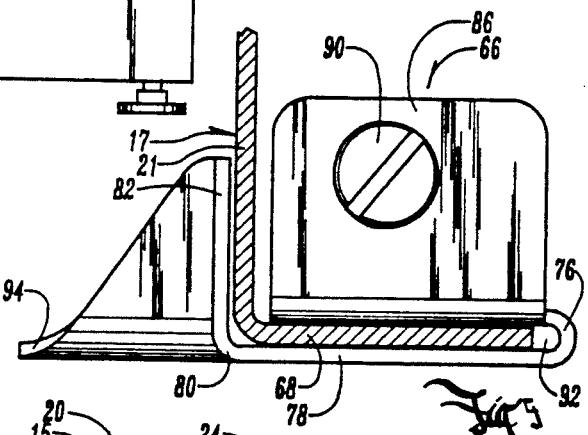
FIG. 5 is a sectional view taken along line 5—5 of FIG. 4.

Inner plate 74 and middle plate 78 are folded along fold line 76 approximately 180 degrees with respect to one another so that they are spaced apart and parallel to form a slot 92 (FIGS. 5, 9, and 10). Slot 92 is sized to receive the horizontal flange 68 at the lower edge of tub support side wall 21. As can be seen in FIGS. 9 and 10, the bracket 66 is initially formed in the shape shown in FIG. 9, with middle plate 78 extending at approximately 45 degrees with respect to inner plate 74. The bracket 66 is installed at the time of manufacture by crimping or folding the bracket from the configuration shown in FIG. 9 to the configuration shown in FIG. 10, wherein middle plate 78 and upper plate 74 are approximately parallel with one another so as to form the slot 92. This also causes outer plate 82 to engage the outside lower edge of tub support side wall 21, thereby causing the bracket to be retained on the L-shaped configuration formed by the lower edge of tub support side wall 21 and the horizontal flange 68. In this configuration, however, the bracket 66 is free to slide longitudinally along the length of horizontal flange 68.

Figure 4:
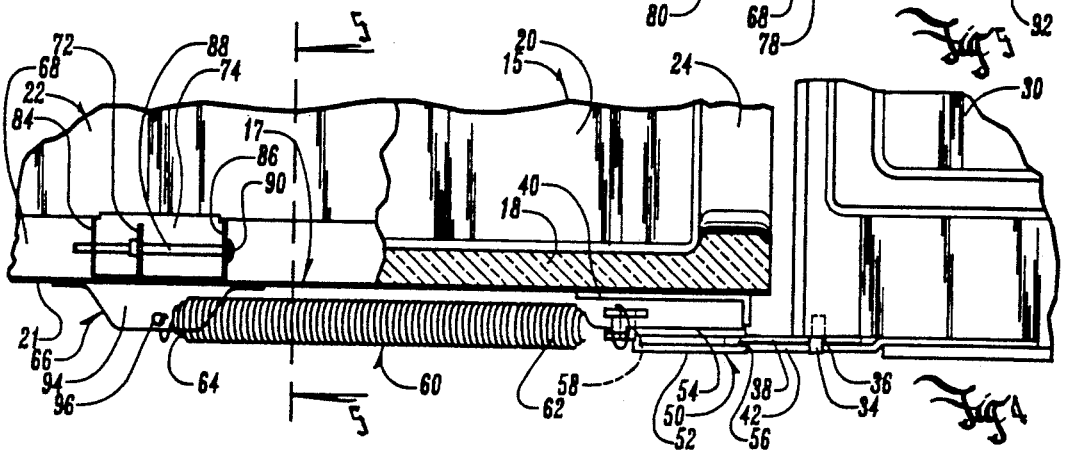
FIG. 4 is a sectional view taken along line 4—4 of FIG 3.

Outer plate 82 includes a horizontal central portion 94 (FIG. 8) having a spring mounting hole 96 which receives the lower end 64 of spring 60 as shown in FIGS. 3 and 4.

The spring 60 is shown mounted on the outside of the tub support wall 21, and for this reason the spring 60 is not accessible when the dishwashing machine 10 has been installed beneath counter 12. However, the inner plate 74 and the head 90 of lead screw 88 are accessible from the front of the dishwashing machine merely by removal of the access panel 28. It is then possible to gain access through access opening 26 to the head 90 of lead screw 88 and cause rotation of the lead screw 88. This moves the bracket longitudinally toward or away from the door 30, thereby increasing or decreasing the tension in spring 60 as desired. The use of a lead screw adjustment permits infinite adjustment of the position of the bracket 66, and correspondingly permits infinite adjustment of the tension in the spring 60. Thus, the present invention provides an improvement over prior devices by providing easy access to the adjustment means without the necessity of working through small openings in side supports or pulling the dishwashing machine out from its installation beneath counter 12.

The preferred embodiment of the invention has been set forth in the drawings and specification, and although specific terms are employed, these are used in a generic and descriptive sense only and not for purposes of limitation. Changes in the form and proportion of parts as well as in the substitution of equivalents are contemplated as circumstances may suggest or render expedient without departing from the spirit or scope of the invention as further defined in the following claims.

I claim:

1. In combination:

an appliance cabinet having a top wall, opposite side walls, a front wall and a rear wall, said front wall having a door opening therein;

a door hinged to said cabinet for movement about a hinge axis from a closed position in covering relation over said door opening to an open position;

a bracket movably mounted to said cabinet for movement between first and second positions;

bracket adjustment means engaging said bracket and holding said bracket against movement relative to said cabinet, said adjustment means being capable of manual manipulation to move said bracket to, and hold said bracket in, a plurality of positions between said first and second positions;

said bracket adjustment means being at least partially between said opposite side walls;

spring means having a first end connected to said door and a second end connected to said bracket and yieldably biasing said door with a counterbalance force toward said closed position, whereby movement of said bracket to said plurality of positions between said first and second positions will cause adjustment of the magnitude of said counterbalance force.

2. A combination according to claim 1 wherein said bracket includes a first portion located between said opposite side walls of said cabinet for engagement with said bracket adjustment means.

3. A combination according to claim 2 wherein said spring means is positioned outside said cabinet side walls and said bracket includes a second portion outside said cabinet side walls and connected to said second end of said spring means.

4. A combination according to claim 3 wherein said bracket is movably mounted to one of said side walls of said cabinet.

5. A combination according to claim 4 wherein said one side wall includes elongated guide means and said bracket is mounted to said guide means for movement between said first and second positions.

6. A combination according to claim 5 wherein said guide means comprises a horizontal flange adjacent a bottom edge of said one side wall.

7. A combination according to claim 6 wherein said bracket includes a central portion interconnecting said first and second portions, said central portion extending around and below said horizontal flange.

8. A combination according to claim 1 wherein said front wall includes a second opening therein and a removable panel detachably secured over said second opening, said bracket adjustment means being accessible through said second opening.

9. A combination according to claim 1 wherein said bracket adjustment means comprises a lead screw threadably engaging said cabinet and rotatably mounted to said bracket whereby rotation of said lead screw causes movement of said bracket between said first and second positions.

10. A movable spring bracket adapted to be mounted to a cabinet of an appliance, said cabinet including an elongated horizontal member having in crosssection a first leg and a second leg disposed at an angle with respect to one another, a door hinged to said cabinet for hinged movement about a hinge axis between open and closed positions, and a spring having a first end connected to said door and a second end, said bracket comprising:

a bracket body having first, second, and third members interconnected with one another, a first fold line being between said first member and said second member, and a second fold line being between said second and said third members;

said first and second members being approximately parallel and spaced apart from one another so as to form a slot therebetween, said slot being sized to slidably receive said first leg of said horizontal member for sliding movement of said bracket body longitudinally along said horizontal member;

said third member being disposed at an angle with respect to said second member so as to cause said third member to slidably engage said second leg of said horizontal member when said first leg of said horizontal member is within said slot whereby said bracket body will retentively engage said elongated horizontal member and will be free to slide longitudinally thereon;

adjustment means connected to said first member of said bracket body and adapted to engage said cabinet for causing longitudinal sliding movement of said bracket body on said horizontal member;

spring attachment means on said third member for attaching said bracket body to said second end of said spring.

11. A spring bracket according to claim 10 wherein said adjustment means comprises a threaded member rotatably mounted to said first member of said bracket body.

12. A spring bracket according to claim 11 wherein a pair of spaced apart tabs are fixed to said first member of said bracket body, said threaded member extending between said spaced apart tabs and being rotatably mounted thereto.

13. In combination:, an appliance cabinet having a top wall, opposite sidewalls, a front wall, a rear wall, and an interior compartment, said front wall having a door opening and a second opening therein;

a door hinged to said cabinet for movement about a hinge axis from a closed position in covering relation over said door opening to an open position;

bracket means movably mounted to said cabinet for movement between first and second positions;

spring means connected to both of said bracket means and said door, said spring means yieldably biasing said door with a counterbalance force toward said closed position;

adjustment means connected to said bracket means for moving said bracket means between said first and second positions to cause adjustment of said counterbalance force which said spring means applies to said door;

said adjustment means being positioned to be accessible from outside said front wall of said cabinet.

14. A combination according to claim 13 wherein said spring means is positioned outside said interior compartment.

15. A combination according to claim 14 wherein said bracket means includes a first portion within said interior compartment and a second portion outside said interior compartment, said second portion being connected to said spring means.

16. A combination according to claim 13 wherein said bracket means is movably mounted to said cabinet for movement toward and away from said door.

17. A combination according to claim 16 wherein said spring adjustment means is connected to said bracket means and said cabinet means for causing said bracket means to move toward and away from said door.

18. A combination according to claim 17 wherein said spring adjustment means comprises a threaded member rotatably mounted to said bracket means and threadably engaging said cabinet.

19. A combination according to claim 13 wherein at least a portion of said adjustment means is within said interior compartment.

20. A combination according to claim 13 wherein said adjustment means is positioned adjacent said front wall and said second opening of said front wall.

* * * * *